United States Patent [19]

Gertsch

[11] 4,018,456

[45] Apr. 19, 1977

[54] SKI BINDING WITH RELEASE PLATE

[75] Inventor: Ulrich Gertsch, Matten, Switzerland

[73] Assignee: Gertsch AG, Zug, Switzerland

[22] Filed: Nov. 18, 1975

[21] Appl. No.: 632,994

[30] Foreign Application Priority Data

Nov. 19, 1974 Switzerland ..... 15349/74

[52] U.S. Cl. ..... 280/618

[51] Int. Cl.[2] ..... A63C 9/086

[58] Field of Search ..... 280/618, 614, 636, 617, 280/613

[56] References Cited

UNITED STATES PATENTS

| | | | |
|---|---|---|---|
| 2,649,306 | 8/1953 | Hilding | 280/618 |
| 3,489,424 | 1/1970 | Gertsch et al. | 280/618 |
| 3,874,685 | 4/1975 | von Besser | 280/618 |
| 3,909,025 | 9/1975 | Gertsch et al. | 280/618 |
| 3,921,995 | 11/1975 | Moog | 280/625 |
| 3,930,661 | 1/1976 | Marker | 280/618 |

FOREIGN PATENTS OR APPLICATIONS

| | | | |
|---|---|---|---|
| 92,569 | 11/1922 | Austria | 280/618 |
| 2,117,324 | 7/1972 | France | 280/618 |
| 1,340,309 | 9/1963 | France | 280/614 |
| 412,672 | 11/1966 | Switzerland | 280/620 |

*Primary Examiner*—Joseph F. Peters, Jr.
*Assistant Examiner*—David M. Mitchell
*Attorney, Agent, or Firm*—Martin A. Farber

[57] ABSTRACT

A ski binding with release plate which extends substantially over the entire length of the sole, mounted rotatably and liftably in the range of an extension of the axis of the leg of the skier by a pivot pin screwed on the ski, and latched or releasably locked to the side and/or upwardly at both ends by means of release mechanisms, respectively. The release plate is provided in the vicinity of the ball of the foot with a hinge which is operative only upwardly, thus away from the ski, while downwardly, toward the ski, a rigid abutment is provided.

17 Claims, 10 Drawing Figures

SKI BINDING WITH RELEASE PLATE

The present invention relates to a ski binding with release plate.

It is an object of the invention to provide an improved ski binding with release plate having advantages with respect to safety, and skiing as well as construction.

The present invention relates to a ski binding with release plate which extends substantially over the entire length of the sole, mounted rotatably and removeably liftably in the range of an extension of the axis of the leg of the skier by means of a pivot pin, the latter being screwed onto the ski, and latched or releaseably locked to the side and/or upwardly at both ends by means of release mechanisms, respectively. In accordance with an object of the invention to so provide, this release plate is characterized in the manner that it has, in the vicinity of the ball of the foot, a hinge which is operative only upwardly, thus away from the ski, while downwardly, toward the ski, a rigid abutment is provided.

This hinge in accordance with an ojbect of the invention has the purpose to shift the point or axis of rotation or pivoting of a forward release from the tip of the boot into the vicinity of the ball of the foot, which is technically advantageous with respect to safety. Although the point or axis of rotation or pivoting which occurs during a front tumble or fall lies under the ball of the foot, the release mechanism can be arranged in front of the front tip of the boot, where no limitation of the overall height occurs, so that a freer choice is made possible regarding construction.

In accordance with another object of the invention to so provide, an advantageous embodiment of the invention resides in that the front sole holding apparatus 7 is connected directly with the axle of the hinge, or behind the hinge, with the release plate. In this manner deformation of the sole of the shoe, as well as snow or dirt could not influence the functioning of the front release mechanism.

The ski binding in accordance with the present invention, besides the technical-safety advantage, also is advantageous with respect to skiing technique. With the bending or flexing of the ski, the plate can participate in the bending or flexing so that no stiffening of the middle part of the ski occurs and the contact between the plate and the ski uniformly is preserved. By means of employment of the plate, yet, the necessary independence of the boot is guaranteed and insured for the boot held in the binding.

With the above and other objects in view, the present invention will become more clearly understood from the following description of a preferred embodiment of the invention with respect to the accompanying drawings, of which:

Figure 1:
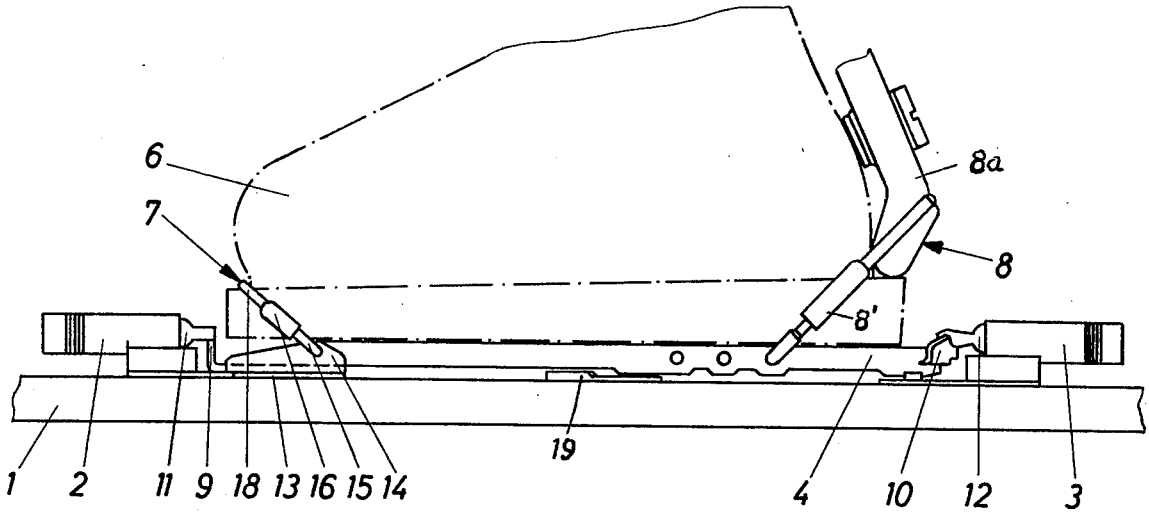
FIG. 1 is a side elevational view of a ski binding in accordance with the invention with the ski shown partly broken away and the ski boot indicated in dot-dashed lines.
Figure 2:
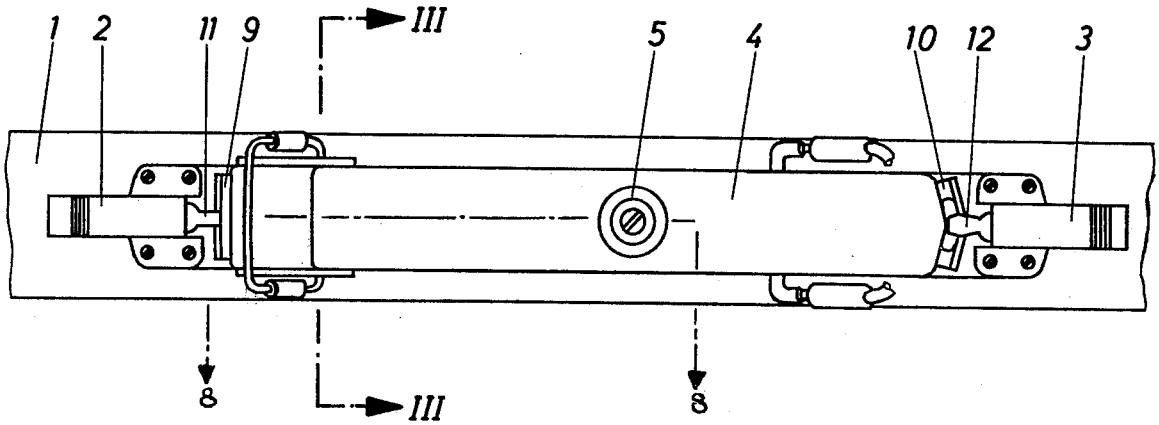
FIG. 2 is a top plan view of FIG. 1 with the rear sole holder partly broken away.

Referring now to the drawings, and more particularly to FIGS. 1 and 2, in accordance with the present invention, a preferred embodiment of a ski binding with a release plate comprises a release plate 4 which is held on the ski 1 by means of a front safety holding device or release mechanism 2 and a rear safety holding device or release mechanism 3. The release plate 4 is pivotally and liftably mounted relative thereto on a pivot pin 5 screwed onto ski 1, the pivot pin 5 being screwed to the ski by screw 5*a* (FIG. 8) and being arranged substantially in the center range of the plate 4, as particularly indicated in FIG. 2. The ski boot 6, which has been omitted in FIG. 2 for ease of understanding, is held on the plate by a front sole holding apparatus 7 and a rear heel holding apparatus 8. Besides, the heel hold-down apparatus 8 can be constructed in per se known manner, the upper portion constituting a lever 8*a* connected to angle bars selectively engaging in one of a plurality of holes on each side of and in the release plate as shown, and having a fine adjustment sleeve 8′ threadedly connected to the angle bars, respectively.

The two safety holding devices 2 and 3 on their ends which cooperate with the plate have mushroom type holding elements 11 and 12, respectively, which holding elements cooperate with the coordinated holding end parts 9 and 10, respectively, for the release plate 4, the part 9 constituting the front portion of a hinge 14, and the part 10 being secured to the rear of the release plate. The construction of the mushroom type holding parts 11 and 12 is, for example, described in Switzerland Pat. No. 443,089 or in corresponding publications, such as e.g., Austrian Pat. OE-PS 303,578 or U.S. Pat. No. 3,489,424, hereby incorporated by reference. Thus, this makes a further explanation of these parts unnecessary.

Referring now also to FIGS. 4-8, the hinge or pivot 14, which in cooperative combination with the other features of the binding constitutes the essence of the invention, is held, with insertion of and by the intermediary of a slide or glide plate 13, on the ski by the plate 4. The front holding device 7 is anchored or fastened in the hinge 14. The front holding device comprises an angled spindle or pivot shaft 15, an adjustable sleeve 16 and a shackle or cable 18. As can be recognized from FIG. 3, the release plate 4 as well as the hinge 14 is passed through by the angle bar or shaft 15, so that the position of the hinge 14 is established or fixed with respect to the release plate. In this manner, the pivot point or axis of pivoting of the forward release (safety against front tumbles or falls) is shifted from the front tip of the foot into the range of the ball of the foot (note FIG. 9 where during the beginning of the release during a front fall, the release plate 4 pivots about the pivot axis defined by the shaft passing through the hinge 14 and the plate 4, the hinge 14 initially remaining horizontal in its original position with its lower part 14′ constituting a rigid abutment supported in cooperation against the slide plate 13). The cooperation of the abutment 14' with the lower surface of the release plate prevents downward pivotal movement. Thereby the use of the hinge 14 facilitates the use of a release mechanism arranged in front of the tip of the boot. For this purpose the front holding element or part 9 of the hinge 14 is bent upwardly and cooperates thus with the front mushroom shaped part 11 of the front safety holder device 2.

Figure 10:
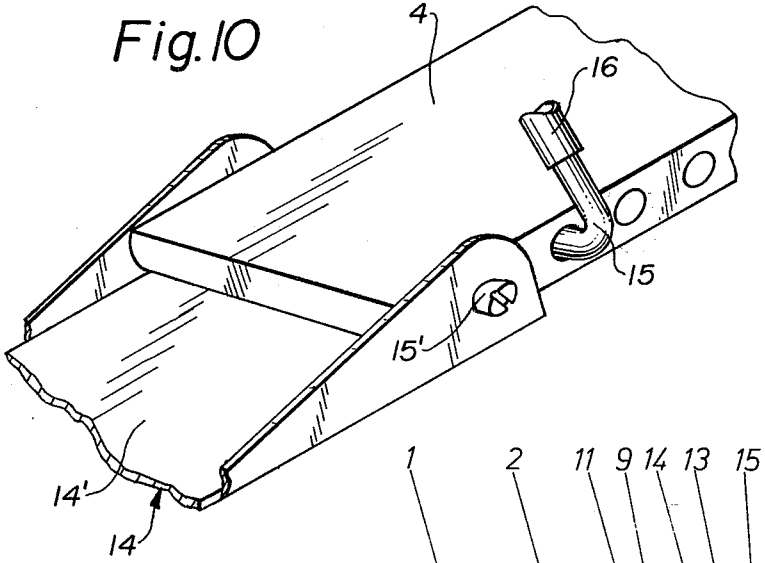

The use of a release plate cooperating with a hinge pivot, further, facilitates greater variations with respect to the length size of the boot, without thus thereby impairing the releasing operation. The front sole holding device 7 may be connected to the release plate 4 in back of the hinge 14, the latter still being hinged at its own separate hinge axle 15' to the release plate (FIG. 10).

Figure 3:
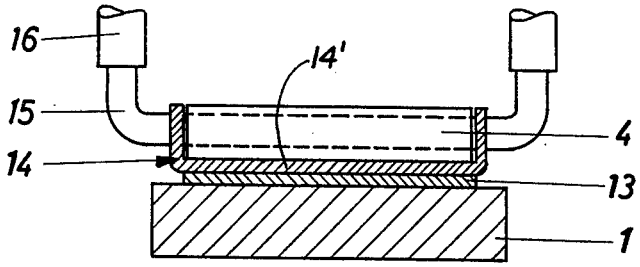
FIG. 3 is a cross-sectional view taken along the lines 3 — 3 of FIG. 2.
Figure 5:
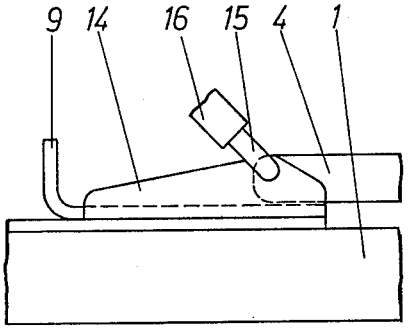
FIG. 5 is a side elevational view of FIG. 4.
Figure 6:
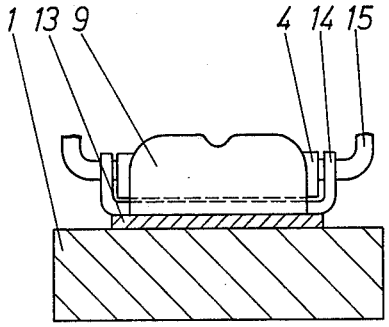
FIG. 6 is a front view of FIG. 4 and 5 partly in section.
Figure 4:
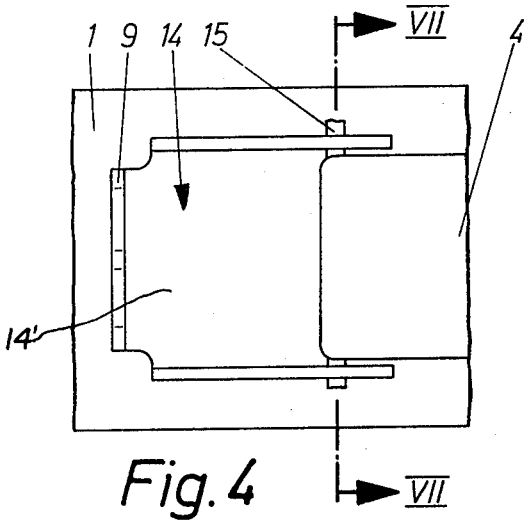
FIG. 4 is a plan view of the hinge 14 on the ski showing the end of the release plate thereon, but not showing the front safety holding device.
Figure 7:
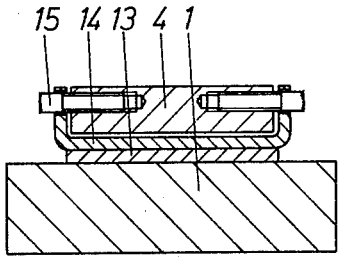
FIG. 7 is a section taken along the lines VII — VII of FIG. 4 yet illustrating a different embodiment.

The embodiment of FIG. 7 is somewhat different than that of FIG. 3. In FIG. 7, although not illustrated with a reference character, the angle spindles 15 have ends which extend into the release plate 4, which ends have threads or screw threads thereon.

Figure 8:
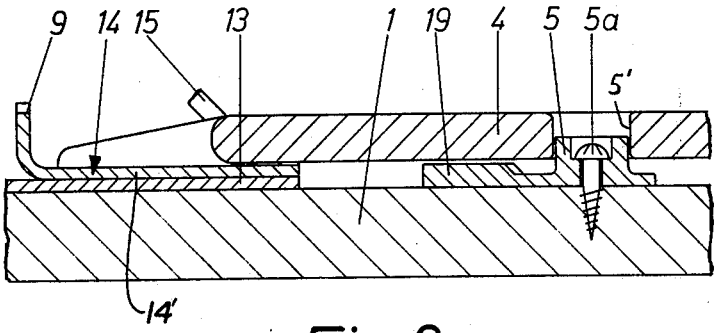
FIG. 8 is a section taken along the lines 8 — 8 of FIG. 2.
Figure 9:
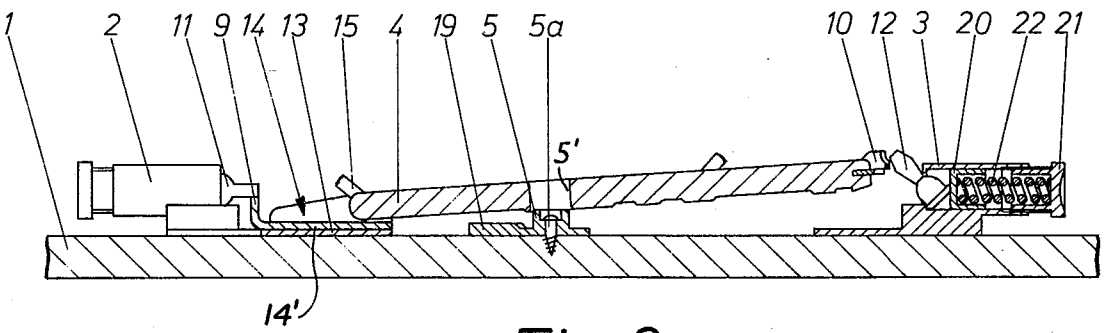
FIG. 9 is a longitudinal cross-sectional vertical view of the ski binding during a fall toward the front and FIG. 10 is a partly broken away perspective view of another emmbodiment with the front sole holding device connected to the release plate behind the hinge.

Referring now again to the drawings, and more particularly to FIG. 8 which shows the bearing or mounting member 19 of the pivot pin or pivot member 5 (in this figure the holding element 11 of the front holding device 2 has been omitted for clarity of illustration), the pivot pin 5 is rigidly connected to the ski 1 by the screw 5*a*. FIG. 9 shows the ski binding in accordance with the invention during a fall toward the front (the boot not being illustrated for clarity of the figure), in which, a position is shown during which the release plate 4 has not quite yet left the pivot pin 5. By a further pivoting of the release plate 4 upwardly, the insert opening 5' of the release plate becomes released or free from the pivot pin 5, whereby then the release plate 4 could and would slide on the fixed slide plate 13 toward the front together with the hinge 14. In this phase of the release, the holding part 9 is still guided for a short time in the mushroom shaped holding element 11, whereby the rear end holding part 10 of the release plate 4 is released fast from the rear mushroom type holding part 12; and the mushroom type holding part 12, under the action of the spring 22 (which spring acts on the piston 20 of the rear safety holding device 3), returns into the initial position. Here there is also shown how the pretension of the spring 22, inside of the safety holding device 3, is adjustable or regulatable by means of an adjustment screw 21; this construction is per se known and for example extensively described in U.S. Pat. No. 3,489,424. The construction of the front safety holding device 2 is similar, and for this reason has only been illustrated in side elevational view.

The cooperation or interaction per se of the front mushroom type holding element 11 with the upwardly bent holding part 9 is known per se (that is, without regard to the hinge 14 for the release plate 4 in accordance with the present invention) and for example described in U.S. Pat. No. 3,489,424. Further the type of the holding may be recognized particularly by means of FIGS. 4, 6 and 9. It is also evident that the lateral release is dependent on the two guide curves of the holding part 9, as may be seen in FIG. 6, as well as on the formation of the free end of the front mushroom type holding element 11. Also during a fall toward the front — after the release plate 4 is released from the pivot pin 5 —, by means of the holding part 9, the mushroom shaped holding element 11 is operated or actuated against its coordinated spring (not illustrated), similar to that described with the rear safety holding device 3.

The hinge 14 is preferably hinged to the release plate 4 adjacent the front end of the release plate 4, the front end being rounded adjacent thereto.

The manner of operation of the release plate equipped with the hinge in accordance with the invention corresponds as to the rest, to plate bindings of known type.

While I have set forth several embodiments of the present invention it is to be understood that these embodiments are given by example only and not in a limiting sense.

I claim:

1. A ski binding with release plate for a ski boot having a sole, and a ski having thereon release devices, respectively, for holding the release plate to the ski, comprising a release plate substantially corresponding to the distance from the heel of the boot to the ball of the foot, pivot pin means adapted on said ski for rotatably and removeably liftably mounting said release plate in a vicinity of an imaginary extension of the axis of the leg of the skier, said release plate being operatively releaseably held to the side and/or upwardly by the respective release devices, and a hinge means for permitting a pivotal movement of said release plate relative thereto about a transverse axis disposed in a range corresponding to the ball of the foot of the skier only operative upwardly away from the ski, including a rigid abutment means beneath said release plate for preventing a pivotal movement of said plate downwardly toward the ski by contacting a lower surface of said release plate, said hinge means further includes a front holding part extending integrally on said hinge means to a position in front of a front end of said release plate as well as in front of a front tip of the boot. respectively, said front holding part cooperates with a corresponding of said release devices, whereby the latter operatively releaseably holds said release plate via said hinge means.

2. The ski binding, as set forth in claim 1, further comprising a front sole holder means for holding a front end of the boot to said release plate is connected behind said hinge means with said release plate.

3. The ski binding, as set forth in claim 1, further comprising an angled spindle adapted to engage the boot passes through said release plate and said hinge means so that the position of said hinge means is determined with respect to said release plate.

4. The ski binding with release plate, as set forth in claim 3, wherein said angled spindle constitutes part of a front sole holder for the boot which also forms a hinge pin which interconnects said release plate and said hinge means.

5. The ski binding, as set forth in claim 1, wherein said hinge means is articulated to said release plate adjacent a front end of said release plate rearwardly relative to said front tip of the boot, said front holding part engaged with said corresponding release device.

6. The ski binding, as set forth in claim 5, wherein said release plate includes means for mounting the ski boot thereon with said front tip of the boot extending in front of said front end of said release plate, and said front holding part operatively engages in front of the front tip of the boot with said corresponding release device.

7. The ski binding, as set forth in claim 5, wherein said front holding part of said hinge means includes lateral and vertical release means cooperating with said corresponding release device for laterally and vertically releaseably holding said hinge means.

8. The ski binding, as set forth in claim 7, wherein said release means consitutes a curved surface shaped in said front holding part.

9. The ski binding, as set forth in claim 6, wherein said front holding part includes a portion which extends vertically upwardly.

10. The ski binding, as set forth in claim 9, wherein said front holding part extends higher than an upper surface of said release plate.

11. The ski binding, as set forth in claim 5, wherein said hinge means includes a lower part constituting said abutment means disposed partially under said release plate, a slide plate adapted to be disposed on the ski, said lower part of said hinge means is slidably firmly supported on said slide plate.

12. The ski binding, as set forth in claim 5, wherein said front end of said release plate is rounded, said hinge means includes a lower part constituting said abutment means disposed under, and having an upper surface substantially coplanar with, a lower surface of said release plate.

13. The ski binding, as set forth in claim 6, wherein said hinge means being disposed spaced apart opposite from the tip of said boot and having means for the tip of the boot to tilt freely downwardly during a front fall.

14. The ski binding, as set forth in claim 13, wherein said means for the tip of the boot to tilt of said hinge means includes side walls laterally disposed adjacent opposite lateral sides of said front end of said release plate, said side walls taper in a forward direction away from the sole of the boot, thereby providing said space for the tip of the boot to tilt freely downwardly during a front fall.

15. The ski binding, as set forth in claim 6, including a release device disposed completely in front of the tip of the boot and engaging said front holding part of said hinge means.

16. The ski binding, as set forth in claim 15, wherein said release device constitutes a spring biased safety holding member.

17. A ski binding with release plate for a ski boot having a sole, and a ski having thereon release devices, respectively, for holding the release plate to the ski, comprising a release plate substantially corresponding to the distance from the heel of the boot to the ball of the foot, pivot pin means adapted on said ski for rotatably and removeably liftably mounting said release plate in a vicinity of an imaginary extension of the axis of the leg of the skier, said release plate being latched to the side and/or upwardly by the respective release devices, and a hinge means for permitting a pivotal movement of said release plate relative thereto about a transverse axis disposed in a range corresponding to the ball of the foot of the skier only operative upwardly away from the ski, including a rigid abutment means beneath said release plate for preventing a pivotal movement of said plate downwardly toward the ski by contacting a lower surface of said release plate, said hinge means including an axle connecting said hinge means to said release plate, and a front sole holder means for holding a front end of the boot to said release plate being connected directly with said axle of said hinge means.

* * * * *